US009574366B2

(12) United States Patent
Choi

(10) Patent No.: US 9,574,366 B2
(45) Date of Patent: Feb. 21, 2017

(54) CONTROL STRUCTURE FOR FOLDING A SHELTER

(71) Applicant: Campvalley (Xiamen) Co. Ltd., Xiamen, Fujian Province (CN)

(72) Inventor: Kwan Jun Choi, Xiamen (CN)

(73) Assignee: Campvalley (Xiamen) Co. Ltd., Xiamen (CN)

( * ) Notice: Subject to any disclaimer, the term of this patent is extended or adjusted under 35 U.S.C. 154(b) by 0 days.

(21) Appl. No.: 14/270,965

(22) Filed: May 6, 2014

(65) Prior Publication Data

US 2014/0338711 A1 Nov. 20, 2014

(30) Foreign Application Priority Data

May 16, 2013 (CN) ..... 2013 2 0267365

(51) Int. Cl.
*E04H 15/32* (2006.01)
*E04H 15/48* (2006.01)

(52) U.S. Cl.
CPC ..... *E04H 15/32* (2013.01); *E04H 15/48* (2013.01)

(58) Field of Classification Search
CPC ..... E04H 15/48; E04H 15/32; E04H 15/322
See application file for complete search history.

(56) References Cited

U.S. PATENT DOCUMENTS

| | | | |
|---|---|---|---|
| 14,655 | A | 4/1856 | Hartwell |
| 58,283 | A | 9/1866 | Palmer |
| 379,274 | A | 3/1888 | Hamilton |
| 1,061,547 | A | 5/1913 | Kennedy |
| 1,347,107 | A | 7/1920 | McCann |
| 2,113,118 | A | 4/1938 | Pyatt |
| 2,306,706 | A | 12/1942 | Lucas |
| 2,448,895 | A | 9/1948 | Lawrence |
| 2,530,765 | A | 11/1950 | Greenup |
| 2,555,220 | A | 5/1951 | Brown |
| 2,716,993 | A | 9/1955 | Codrick |
| 2,731,972 | A | 1/1956 | Braun |
| 2,948,287 | A | 8/1960 | Rupert |

(Continued)

FOREIGN PATENT DOCUMENTS

| | | | |
|---|---|---|---|
| CA | 2022369 | A1 | 2/1991 |
| CN | 1076987 | A | 10/1993 |

(Continued)

OTHER PUBLICATIONS

International Search Report, PCT Application No. PCT/CN2008/073142, Jan. 22, 2009.

*Primary Examiner* — David R Dunn
*Assistant Examiner* — Danielle Jackson
(74) *Attorney, Agent, or Firm* — Morgan, Lewis & Bockius LLP

(57) ABSTRACT

Described is a control structure for unfolding and folding a collapsible device or shelter. The control structure includes a sliding seat that is pivotally connected to adapter members, which are in turn connected to poles, e.g., tent poles. The tent poles are also pivotally connected to a lower support, and a resilient member (e.g., a spring) forces a separating between the sliding seat the the lower support. The resilient member biases the sliding seat toward the lower support to maintain the control structure in an unfolded position when open, and in a folded position when closed.

9 Claims, 4 Drawing Sheets

(56) References Cited

U.S. PATENT DOCUMENTS

| | | | |
|---|---|---|---|
| 2,962,034 | A | 11/1960 | Finlayson |
| 2,984,249 | A | 5/1961 | Sears, Jr. et al. |
| 3,054,413 | A | 9/1962 | Eshelman |
| 3,333,373 | A | 8/1967 | Taylor et al. |
| 3,738,378 | A | 6/1973 | Williams |
| 3,810,482 | A | 5/1974 | Beavers |
| 3,929,146 | A | 12/1975 | Maiken |
| 4,077,417 | A | 3/1978 | Beavers |
| 4,148,332 | A | 4/1979 | Huddle |
| 4,201,237 | A | 5/1980 | Watts et al. |
| 4,280,521 | A | 7/1981 | Zeigler |
| 4,285,354 | A | 8/1981 | Beavers |
| 4,627,210 | A | 12/1986 | Beaulieu |
| 4,637,748 | A | 1/1987 | Beavers |
| 4,750,509 | A | 6/1988 | Kim |
| 4,787,182 | A | 11/1988 | Serge |
| 4,819,680 | A | 4/1989 | Beavers |
| 4,838,003 | A | 6/1989 | Zeigler |
| 4,941,499 | A | 7/1990 | Pelsue et al. |
| 4,944,321 | A | 7/1990 | Moyet-Ortiz |
| 4,971,090 | A | 11/1990 | Uhl |
| 5,293,890 | A | 3/1994 | Park et al. |
| 5,328,286 | A | 7/1994 | Lee |
| 5,333,634 | A | 8/1994 | Taylor |
| 5,361,794 | A | 11/1994 | Brady |
| 5,423,341 | A | 6/1995 | Brady |
| 5,617,681 | A | 4/1997 | Lyons |
| 5,628,338 | A | 5/1997 | Stumbo |
| 5,634,483 | A | 6/1997 | Gwin |
| 5,666,986 | A | 9/1997 | Fox |
| 5,732,726 | A | 3/1998 | Lee |
| 5,797,695 | A | 8/1998 | Prusmack |
| 5,884,646 | A | 3/1999 | Ju |
| 5,943,837 | A | 8/1999 | Esser et al. |
| 6,021,795 | A | 2/2000 | Long et al. |
| 6,032,430 | A | 3/2000 | Soukup |
| 6,167,898 | B1 | 1/2001 | Larga et al. |
| 6,286,530 | B1 | 9/2001 | Hussey |
| 6,296,415 | B1 | 10/2001 | Johnson et al. |
| 6,463,948 | B2 | 10/2002 | Lee |
| 6,516,823 | B1 | 2/2003 | Glover et al. |
| 6,591,571 | B2 | 7/2003 | Fritsche et al. |
| 6,604,844 | B2 | 8/2003 | Hussey |
| 6,666,223 | B2 | 12/2003 | Price et al. |
| 6,772,780 | B2 | 8/2004 | Price |
| 6,776,179 | B1 | 8/2004 | Chen |
| 6,854,476 | B1 | 2/2005 | Chai |
| 6,868,858 | B2 | 3/2005 | Suh |
| 6,874,519 | B2 | 4/2005 | Chiang |
| 6,892,744 | B2 | 5/2005 | Feldpausch et al. |
| 7,025,075 | B2 | 4/2006 | Suh |
| 7,040,585 | B2 | 5/2006 | Cheng et al. |
| 7,059,094 | B2 | 6/2006 | Yamawaki |
| D544,941 | S | 6/2007 | Rogers |
| 7,311,113 | B2 | 12/2007 | Suh |
| 7,316,239 | B2 | 1/2008 | Yang |
| RE40,544 | E | 10/2008 | Suh |
| 7,481,235 | B2 | 1/2009 | Prusmack |
| 7,546,845 | B2 | 6/2009 | Prusmack |
| 7,607,447 | B1 * | 10/2009 | Han ..... E04H 15/28 135/135 |
| 8,047,218 | B1 * | 11/2011 | Shin ..... E04H 15/28 135/135 |
| 8,069,872 | B2 * | 12/2011 | Bae ..... E04H 15/48 135/147 |
| 8,485,208 | B2 * | 7/2013 | Seo ..... E04H 15/42 135/135 |
| D705,884 | S | 5/2014 | Jin |
| 8,910,648 | B2 | 12/2014 | Jin |
| 2001/0050098 | A1 | 12/2001 | Lee |
| 2003/0005953 | A1 | 1/2003 | Erbetta et al. |
| 2006/0289048 | A1 * | 12/2006 | Choi ..... E04H 15/48 135/135 |
| 2007/0051399 | A1 | 3/2007 | Jung |
| 2007/0215192 | A1 | 9/2007 | Hoffman |
| 2012/0318316 | A1 | 12/2012 | Choi et al. |
| 2013/0014794 | A1 | 1/2013 | Jin |
| 2014/0109945 | A1 | 4/2014 | Jin |
| 2014/0261601 | A1 | 9/2014 | Jin |
| 2014/0290710 | A1 | 10/2014 | Choi |
| 2015/0083177 | A1 | 3/2015 | Hotes |

FOREIGN PATENT DOCUMENTS

| | | | |
|---|---|---|---|
| CN | 1030790 | C | 1/1996 |
| CN | 2506736 | Y | 8/2002 |
| CN | 2635827 | Y | 8/2004 |
| CN | 2697225 | Y | 5/2005 |
| CN | 201013097 | Y | 1/2008 |
| CN | 201103269 | Y | 8/2008 |
| CN | 201129060 | Y | 10/2008 |
| CN | 202767622 | U | 3/2013 |
| CN | 203034904 | U | 3/2013 |
| FR | 1 121 851 | | 8/1956 |
| FR | 68588 | | 5/1958 |
| GB | 2201703 | A | 9/1988 |
| GB | 2259927 | A | 3/1993 |
| KR | 10-2011-0054253 | A | 5/2011 |
| WO | WO 2011/022764 | A1 | 3/2011 |

* cited by examiner

CONTROL STRUCTURE FOR FOLDING A SHELTER

BACKGROUND

As any camper knows, setting up a tent can be difficult and frustrating, particularly at night or in inclement weather. The same is true for other types of collapsible devices and shelters, such as portable awnings, gazebos, screen houses, sunshades, umbrellas, strollers, and cribs. There is therefore a need for methods and devices to facilitate rapid and simple set-up and break down of collapsible devices and shelters.

DETAILED DESCRIPTION

Figure 1:
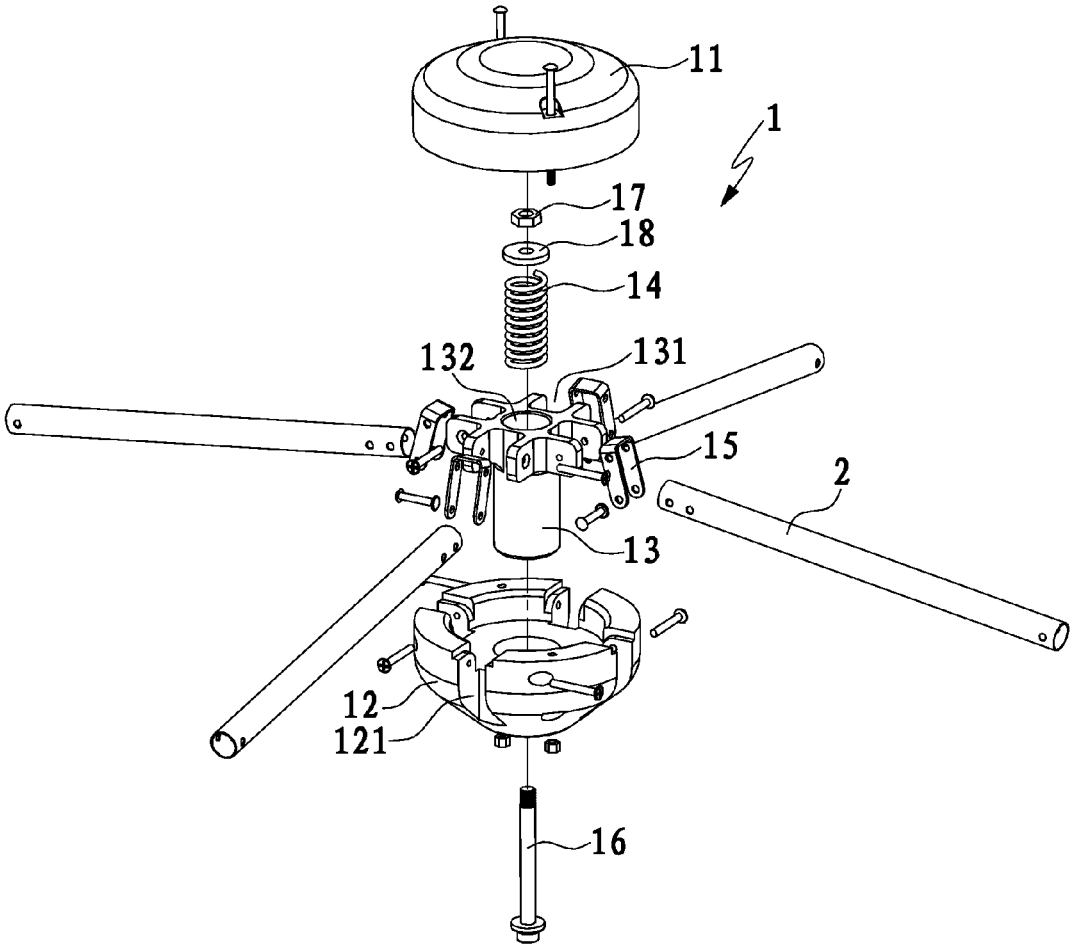
FIG. 1 is an exploded view of the utility model.

FIGS. 1-4B depict a control structure 1 for unfolding/folding a top portion of a collapsible shelter, most commonly a tent or awning. The control structure (e.g., a tent bracket) includes a control structure 1, and at least two poles (e.g., tent poles) 2 (description is presented by taking four tent poles 2 as an example). Each pole is radially pivoted to control structure 1.

Control structure 1 comprises an upper cover 11, a lower support 12, a sliding seat 13, a resilient member 14, and adapter members 15 of a number corresponding to tent poles 2. The upper cover 11 and the lower support 12 enclose a recess (e.g., an accommodating cavity) for accommodating the sliding seat 13, the resilient member 14, and the adapter members 15. Grooves 121 with first pivot connections 150 (FIG. 3) pivotally receive and support corresponding tent poles 2, and are formed at a. periphery of the lower support 12. The groove may also be arranged in the upper cover 11.

Pivoting seats 131 of a number corresponding to the tent poles 2 are arranged radially in the sliding seat 13. In this embodiment, a cavity 132 (e.g., a depressed cavity) may be formed at the central portion of the sliding seat 13 for accommodating the resilient member 14 (e.g., a restoring spring). The resilient member 14 is anchored within the depressed cavity 132 of the sliding seat 13 by means of a rod 16 (e.g., a bolt rod) that cooperates with a screw nut 17 and/or a washer 18. The rod 16 passes through the lower support 12 from its bottom, through the bottom of the sliding seat 13, and then through the resilient member 14, to lock to the washer 18 and/or the screw nut 17.

A first adapter end of each adapter member 15 is pivotally connected to one of pivoting seats 131 of the sliding scat 13 at one of first pivot connections 150. A second adapter end of each adapter ember 15 supports a second pivot connection 151 (FIG. 3) with an inner end of the corresponding tent pole 2. in one embodiment, each adapter member 15 is a U-shaped pivoting tab, having a sealing (e.g., closed) end pivotally connected to a corresponding one of pivoting seats 131 at first pivot connection 150, and an open end that clamps and is pivotally connected to an inner end of a corresponding one of tent poles 2 at second pivot connection 151. Each tent pole 2 extends through one of the grooves 121 of the lower support 12. Each tent pole 2 also includes an inner end pivotally connected to the adapter member 15 at second pivot connection 151, and a third pivot connection 152 (FIG. 3) positioned near the inner end pivotally connected into the groove 121.

Figure 2A:
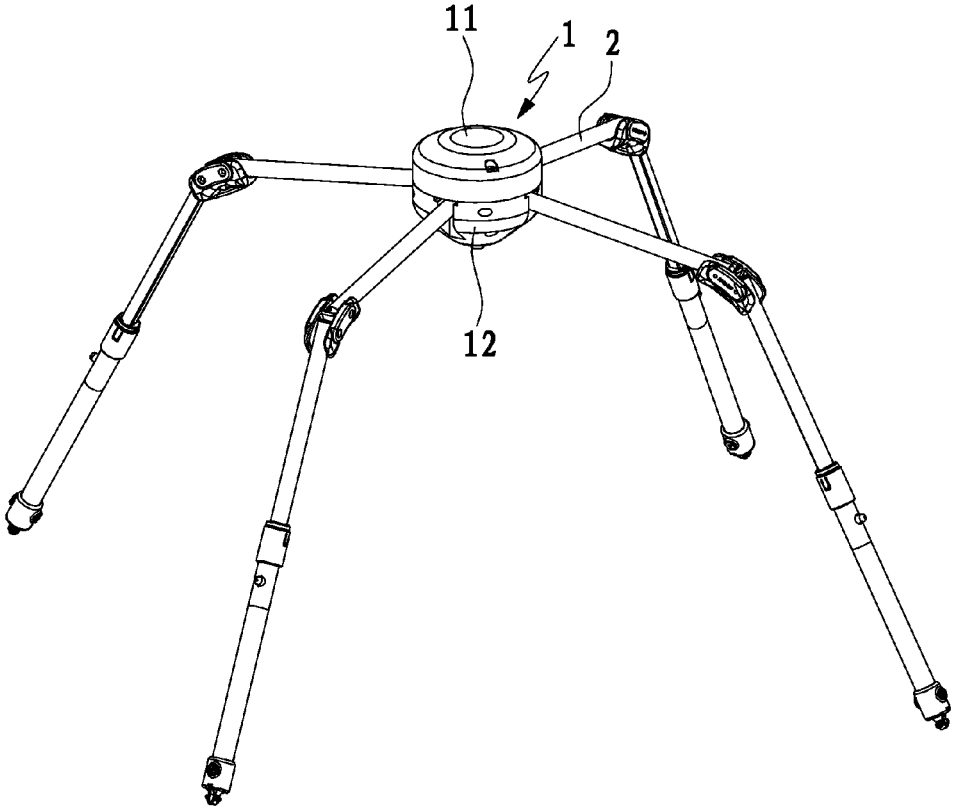
FIG. 2A is a combined external view (unfolded state) of the utility model.
Figure 2B:
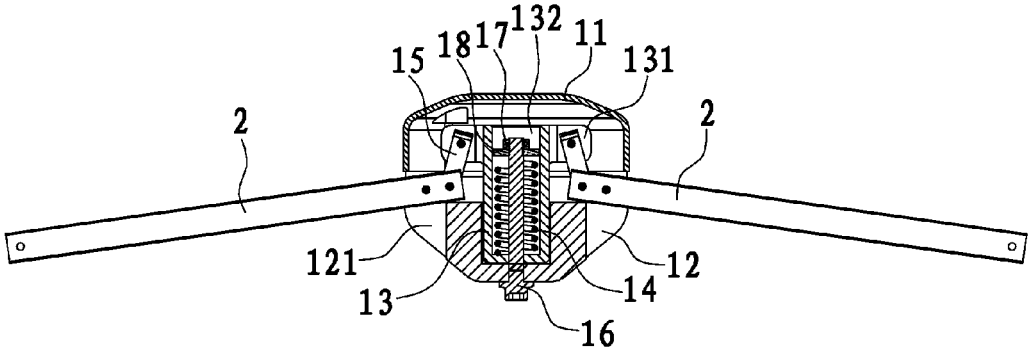
FIG. 2B is a combined sectional view (unfolded state) of the utility model.

As shown in FIGS. 2A-2B, when the control structure is in an unfolded state, the resilient member 14 is its a normal state, and sliding seat 13 is in a first position. The sliding seat 13 is pushed by the resilient member 14 and located at a lower portion of the control structure 1, against a lower surface of the lower support 12. The end of each tent pole 2 in the control structure 1 is subject o a pressing force applied by the sliding seat 13 via the adapter member 15, so that each tent pole and the control structure 1 approximately lie in the same horizontal plane. In this embodiment, the control structure lies in a stable, unfolded state.

Figure 3:
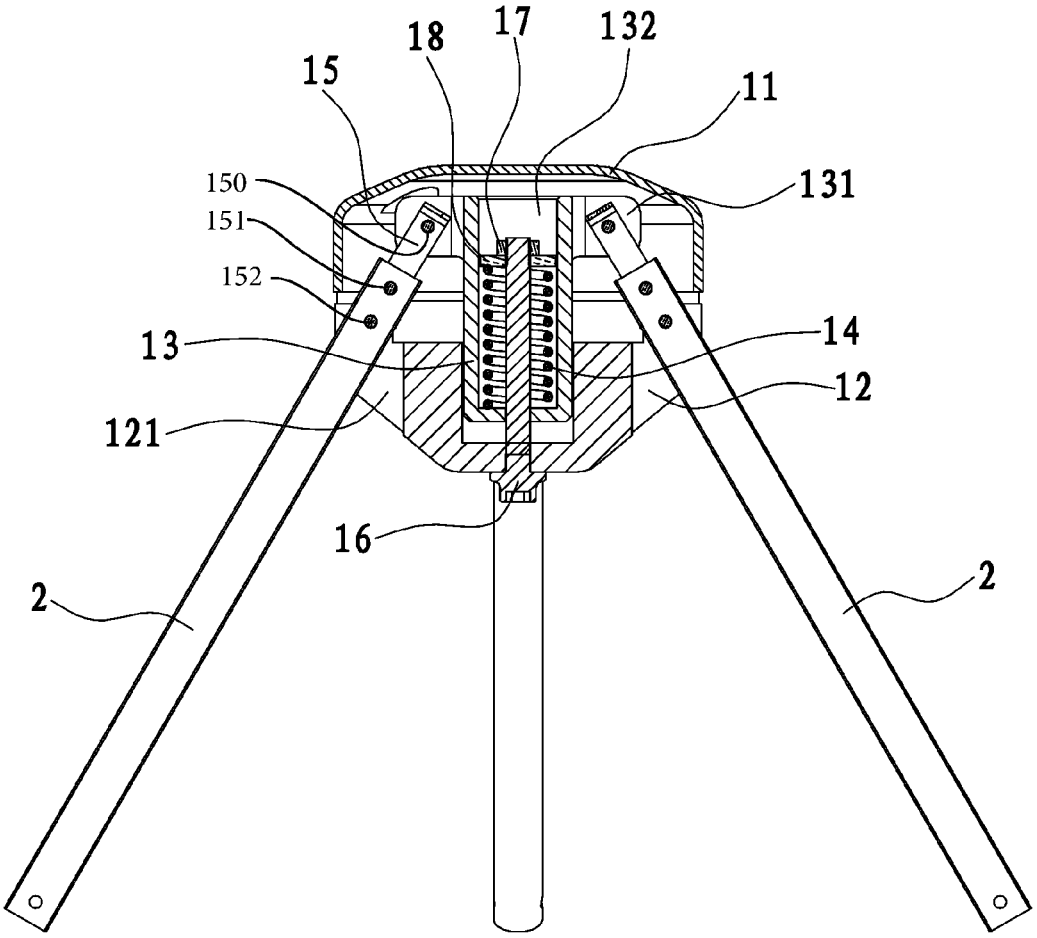
FIG. 3 is a sectional view showing a folding action of the utility model.
Figure 4A:
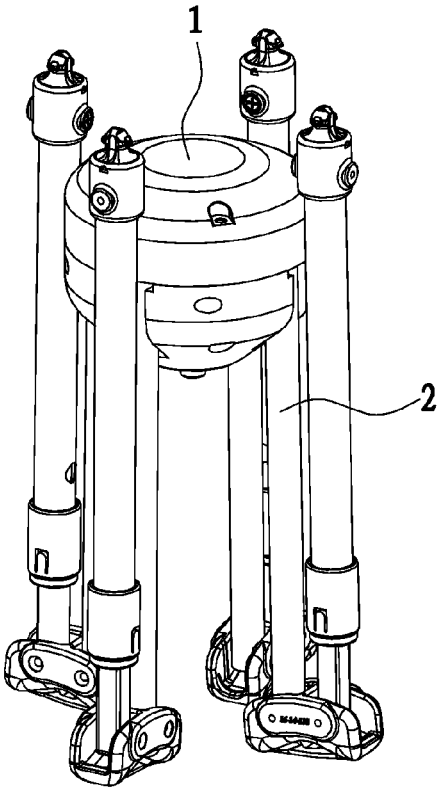
FIG. 4A is an external view showing a folding state of the utility model.
Figure 4B:
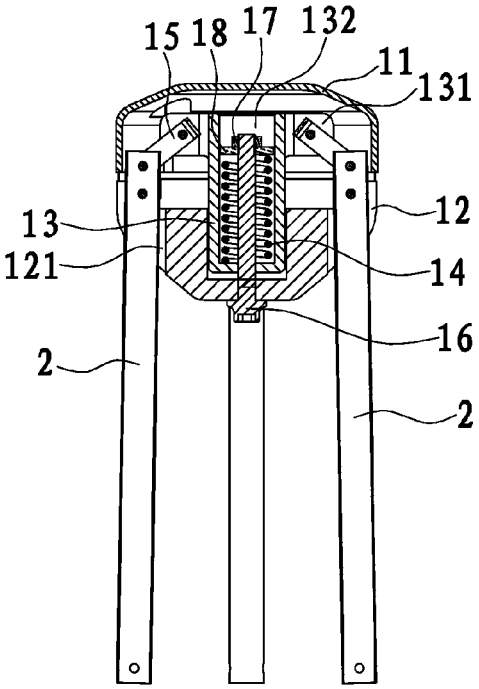
FIG. 4B is a sectional view showing a folding state of the utility model.

With reference to FIGS. 3-4B, to fold the control structure, a downward force is applied to each tent pole 2. In response, the inner ends of tent poles 2 rotate in a first direction, e.g., upward, each pivoting (e.g., rotating or undergoing rotation) at third pivot connection 152. Each adapter member 15 is pushed to rotate upward, pivoting at first pivot connection 150. The adapter member 15 thus drives the sliding seat 13 to move upward relative to lower support 12. When the tent poles 2 are in line with their respective adapter members 15, i.e., when first, second, and third pivot connections 150, 151, and 152 are aligned, sliding seat 13 reaches a position of maximum upward travel. After tent poles 2 have moved downward past their respective in-line positions with respect to adapter members 15, the control structure will have reached the folded state. Sliding seat 13 will have moved downward, but not to its first position. With the control structure in the folded state, sliding seat 13 is at a position higher than that of lower support 12. Therefore, resilient member 14 is in a compressed and energy storing state. A force exerted by resilient member 14 on sliding seat 13 is communicated to member 15 at first pivot connection 150, through member 15, and to the first end of tent pole 2 at second pivot connection 151. Tent pole 2 is thereby biased into the folded position (FIG. 4B). Therefore, it is not necessary to maintain a separate force to keep the control structure in the folded state.

To unfold the tent, a force is applied upward to push away the tent pole 2. In this case, the inner end of each tent pole 2 rotates in a second direction, e.g., downward, by pivoting at the third pivot connection 152, thus pushing adapter member 15 to rotate downward by pivoting at first pivot connection 150. The adapter member 15 further drives the sliding seat 13 to move upward with respect to lower support 12.

As shown in FIG. 3, when each tent pole 2 is positioned with respect to its corresponding adapter member 15 such that the first, second, and third pivot connections 150. 151, and 152 are aligned, sliding seat 13 reaches its limit position for moving upward and away from groove 121 of lower support 12. in other words, the separation between lower support 12 and sliding seat 13 is at a maximum when the first, second, and third pivot connections 150, 151, and 152 are aligned. Rotating poles 2 upward (downward) from this position of alignment causes resilient member 14 to bias control structure 1 in the unfolded (folded) state. The control structure can be automatically unfolded by means of linkage movement of the adapter member 15 during the downward movement of sliding seat 13, as shown in FIG. 2A.

The resilient member 14 can be directly arranged between the sliding seat 13 and the upper cover 11 to provide a force for automatically restoring the sliding seat 13, which can also realize the functions described above.

To sum up, the sliding seat 13 is able to move upward and downward within the control structure. By moving sliding seat 13 upward and downward, it is possible to unfold and fold the control structure. The adapter member 15 further functions to restrict the stable position of the tent pole 2, thus ensuring stability of the tent in the unfolded and folded states, and avoiding the potential risk that the control structure automatically bounces off after folding or unfolding. Moreover, because sliding seat 13, resilient member 14, and adapter member 15 accommodated in the recess (accommodating cavity) of control structure 1, control structure 1 has a neat and beautiful appearance and also provides protection for various components within the pivoting seats so that the performance and lifetime of the product is ensured.

Although the invention has been described in connection with specific embodiments, variations of these embodiments will be obvious to those of ordinary skill in the art. For example, control structures and related components for folding poles and the like can be used to advantage, e.g., for other types of collapsible devices and shelters such as portable awnings, gazebos, screen houses, sunshades, umbrellas, strollers, and cribs. Other modifications and variations likewise fall within the scope of the appended claims. Therefore, the spirit and scope of the claims should not be limited to the foregoing description.

Only those claims specifically reciting "means for" or "step for" should be construed in the manner required under the sixth paragraph of 35 U.S.C. §112.

What is claimed is:

1. A control structure, comprising:

an upper cover;

a lower support having a plurality of grooves, wherein the upper cover and the lower support form an accommodating cavity;

a sliding seat disposed in the accommodating cavity formed by the upper cover and the lower support and having a plurality of first pivot connections;

a plurality of adapter members disposed in the accommodating cavity formed by the upper cover and the lower support, each adapter member having a first adapter end pivotally connected to the sliding seat at a corresponding first pivot connection of the sliding seat, and having a second pivot connection;

a plurality of poles, each:

having an inner end and an outer end along a longitudinal direction of the pole, wherein the inner end is pivotally connected to the second pivot connection of a corresponding adapter member, and the outer end is configured to be connected to a tent pole, having a third pivot connection adjacent the inner end and between the inner and outer ends, wherein the third pivot connection is connected to a corresponding groove of the lower support, and extending through the corresponding groove of the lower support; and a resilient member disposed between the lower support and the sliding seat, the resilient member forcing the sliding seat toward the lower support;

wherein a separation between the lower support and the sliding seat is at a maximum when the first, second, and third pivot connections are aligned.

2. The control structure of claim 1, wherein the sliding seat extends into a recess in the lower support.

3. The control structure of claim 2, wherein the sliding seat includes a cavity that encloses the resilient member.

4. The control structure of claim 3, further comprising a rod extending through the recess and the resilient member.

5. The control structure of claim 1, wherein the first pivot connections are arranged radially in the sliding seat.

6. The control structure of claim 5, wherein the adapter member is U-shaped.

7. The control structure of claim 1, wherein the control structure enters the folded state in response o rotation of the pole about the third pivot connection in a first direction.

8. The control structure of claim 7, wherein the control structure enters an unfolded state in response to rotation of the pole about the third pivot connection in a second direction.

9. The control structure of claim 8, wherein the first and second directions are different.

* * * * *